US005934349A

United States Patent [19]

Faller

[11] Patent Number: 5,934,349

[45] Date of Patent: Aug. 10, 1999

[54] RETRACTABLE AWNING WITH COOLING FAN

[75] Inventor: Kenneth M. Faller, Thorton, Colo.

[73] Assignee: Carefree/Scott Fetzer Company, Broomfield, Colo.

[21] Appl. No.: 08/979,757

[22] Filed: Nov. 26, 1997

[51] Int. Cl.[6] ..... E06B 9/00

[52] U.S. Cl. ..... 160/127; 160/395; 160/370.21; 160/DIG. 5; 248/343

[58] Field of Search ..... 160/127, 395, 160/45, 47, 370.21, 370.22, 370.23, DIG. 2, DIG. 3, DIG. 4, DIG. 5; 248/222.52, 343; 416/244

[56] References Cited

U.S. PATENT DOCUMENTS

| | | | |
|---|---|---|---|
| 2,643,053 | 6/1953 | Sherman et al. | 160/127 |
| 2,787,321 | 4/1957 | Dietz | 160/47 |
| 2,894,576 | 7/1959 | Williams | 160/DIG. 3 |
| 5,024,412 | 6/1991 | Hung et al. | 248/343 |
| 5,148,849 | 9/1992 | Faludy | 160/127 X |
| 5,242,004 | 9/1993 | Stilling | 160/395 X |
| 5,560,411 | 10/1996 | Becker | 160/47 X |
| 5,567,117 | 10/1996 | Gunn et al. | 416/244 |
| 5,667,731 | 9/1997 | Junkel et al. | 261/24 |
| 5,845,886 | 12/1998 | McCormick | 248/200.1 |

OTHER PUBLICATIONS

Brochure on "FanDangler". No date.

*Primary Examiner*—Daniel P. Stodola
*Assistant Examiner*—Bruce A. Lev
*Attorney, Agent, or Firm*—Dorsey & Whitney LLP

[57] ABSTRACT

A retractable awning for mounting on a support surface includes an awning canopy and supporting rafter and support arms with the canopy having its outer edge secured to a roll bar. The roll bar includes an elongated groove in which a fan is removably mounted with the fan including a mister system for humidifying the air emanating from the fan blades. The awning includes connection lines for a supply of liquid and electric power for the fan.

7 Claims, 3 Drawing Sheets

RETRACTABLE AWNING WITH COOLING FAN

BACKGROUND OF THE INVENTION

1. Field of the Invention

The present invention relates generally to retractable awnings and, more particularly, to an improved retractable awning wherein a fan is provided therein to cool the area under the awning.

2. Description of the Relevant Art

Retractable awnings may take numerous forms and have been designed for permanent mounting on fixed vertical surfaces such as over doors and windows of building structures and have also been designed for mounting on movable objects such as recreational vehicles, mobile homes or the like. In the latter case, the awnings typically include a canopy that is secured along an inner edge to a supporting external wall of the vehicle and along an opposite parallel edge to a roll bar such that as the roll bar is moved away from the supporting surface, the canopy of the awning is extended. A reverse relationship is sometimes utilized wherein the roll bar is permanently mounted on the supporting surface and a lead bar attached to an opposite edge of the canopy is adapted to be extended away from the supporting surface to move the awning into an extended position. In either instance, however, the awning is wrapped around the roll bar when it is in its retracted condition. Support arms and rafter arms are typically provided to retain the awning in its extended condition.

To varying degrees, depending upon the fabric or material from which the awning canopy is made, it frequently is hot underneath the canopies as air circulation is somewhat stymied by the canopy itself. Circulating air is one way of lowering the effective temperature under the awning and humidifying the air would be an added benefit for cooling purposes. To applicant's knowledge, however, there are no known awnings that include systems for circulating and humidifying the air under the awning and it is to overcome this shortcoming in prior art retractable awnings that the present invention has been developed.

SUMMARY OF THE INVENTION

In the present invention, the improvement resides in a convenient and practical system for moving and humidifying the air under a retractable awning so as to have an effective cooling system. The fan in accordance with the present invention is removably mountable on the roll bar of the awning and universally adjustable to desirably direct an air stream across the area beneath the canopy.

Some roll bars utilized in retractable awnings have elongated slots or grooves provided in their outer surface for various utilitarian functions. One groove, for example, is typically utilized to anchor the outer or leading edge of the awning canopy while another groove might be utilized for supporting a valance or other decorative item. Further, utility grooves or slots are now being utilized for other utilitarian purposes such as, for example, to house a lighting source for the area under the canopy with an example of such being disclosed in U.S. Pat. No. 5,148,849 which is of common ownership with the present application.

The fan incorporated in the awning of the present invention is removably mounted in the utility slot or any other similar groove provided in the roll bar so as to be slidable along the length of the roll bar and thereby positionable at any desired location along the length of the roll bar. The fan includes a rotary motor, which is preferably a 12 volt electric motor, that drives a conventional fan blade disposed within a fan blade cage. A support structure is secured to the motor housing and includes an elongated bead that is slidably disposed within the utility or other slot in the roll bar, as well as systems for adjusting the orientation of the fan blades about both horizontal and vertical axes. A connection cord to an electrical supply source is incorporated into a rafter arm so as to be easily accessible for connection to an electric cord from the fan motor.

A liquid dispensing mister is incorporated into the fan in alignment with the air stream delivered by the fan and includes a pair of liquid emitting nozzles that direct a spray of liquid into the air stream from the fan so as to humidify the air stream thereby enhancing the cooling effect of the fan. The mister is adapted to be connected to a liquid supply line that is incorporated into a support arm of the awning so that the mister can be quickly and easily connected to and disconnected from a liquid supply source.

Other aspects, features, and details of the present invention can be more completely understood by reference to the following detailed description of a preferred embodiment, taken in conjunction with the drawings and from the appended claims.

DESCRIPTION OF THE PREFERRED EMBODIMENT

Figure 1:
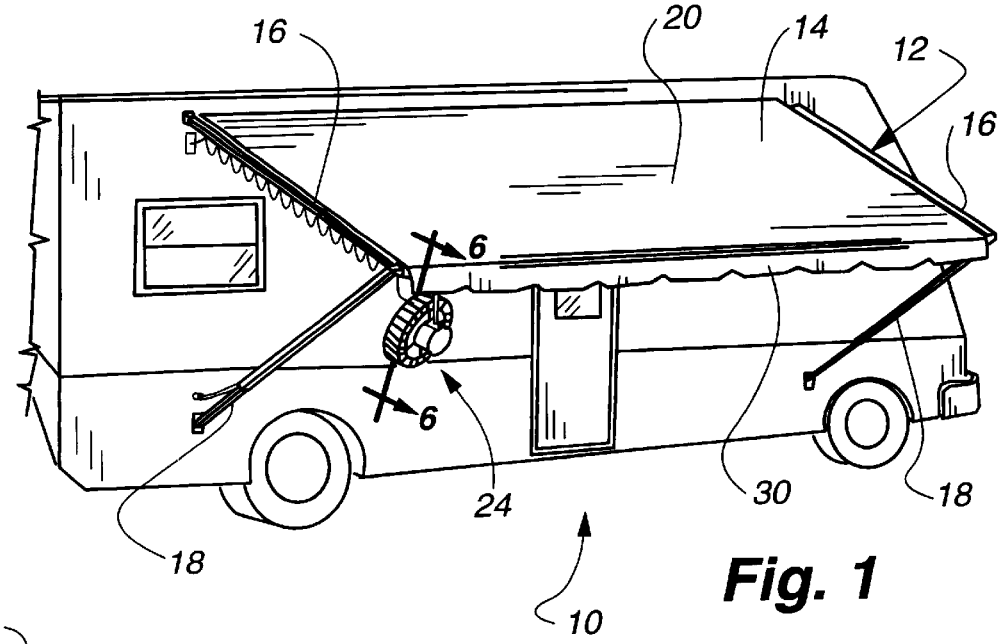
FIG. 1 is a fragmentary isometric view of a recreational vehicle having a retractable awning mounted on the side thereof and with the awning having a fan suspended from the roll bar in accordance with the present invention.

Looking first at FIG. 1, a recreational vehicle 10 is shown with the retractable awning 12 of the present invention mounted thereon. The retractable awning is somewhat conventional in having an awning canopy 14, a pair of upper telescoping rafter arms 16 and a pair of lower telescoping support arms 18 attached to the side of the vehicle and supporting the awning in an extended position as illustrated, or a retracted position wherein the rafter arms and support arms are disposed adjacent the support surface and in parallel relationship with each other. The outer edge 20 of the awning canopy is secured to a roll bar 22 which is rotatably supported on the ends of the support arms 18 so that when the awning is moved between the extended and retracted positions, the awning canopy 14 can be rolled about the roll bar so as to be conveniently stored adjacent the side of the vehicle. The awning 12 further includes a removably mounted fan 24 that is suspended from the roll bar when the awning is fully extended.

Figure 2:
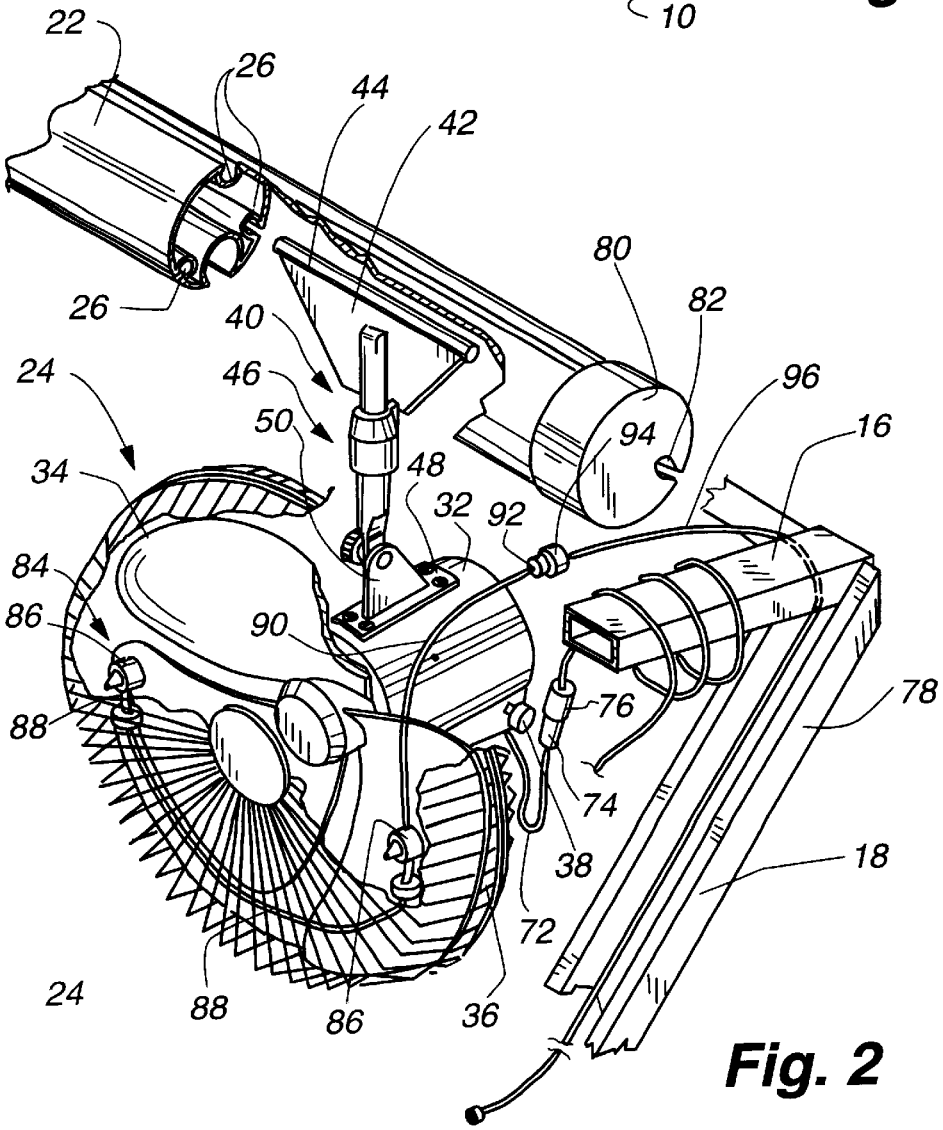
FIG. 2 is an enlarged fragmentary section taken along line 2—2 of FIG. 1 with parts removed showing the mounting of the fan to the roll bar.
Figure 3:
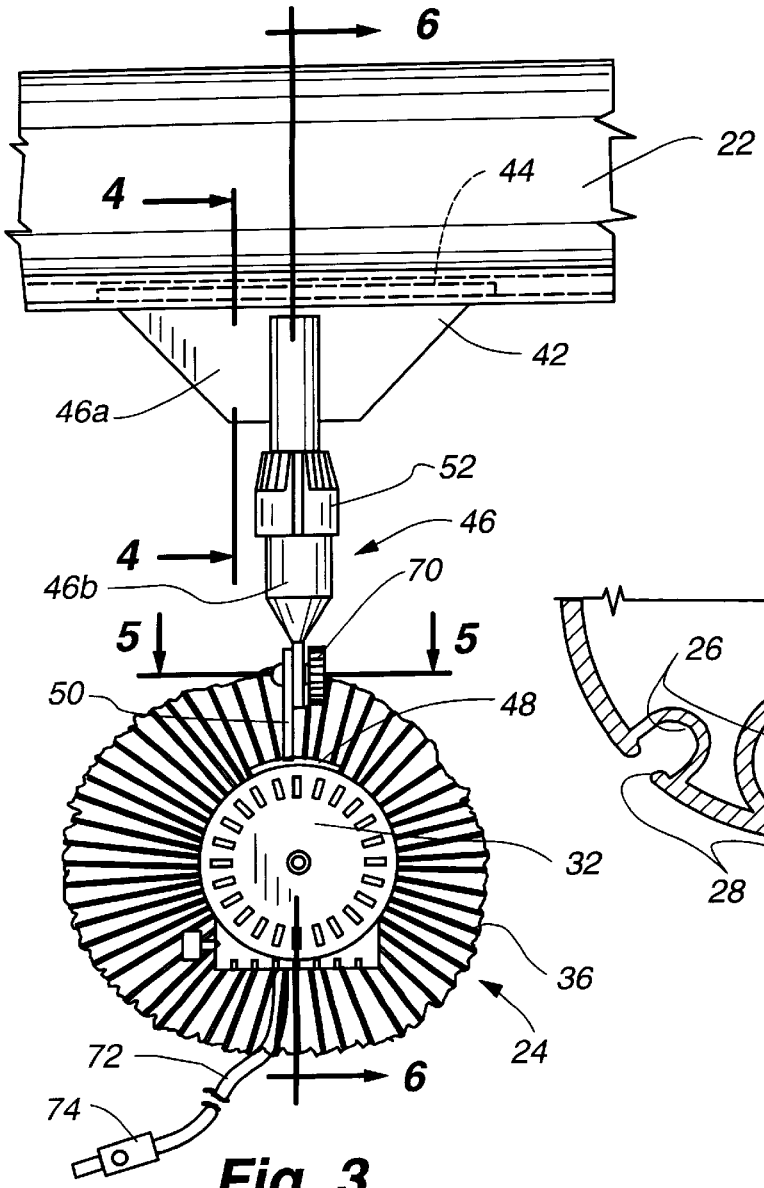
FIG. 3 is a fragmentary front elevation showing the front side of the roll bar and the back side of the fan with the fan positioned in parallel relationship with the roll bar so as to emit a stream of air perpendicular to the roll bar.
Figure 4:
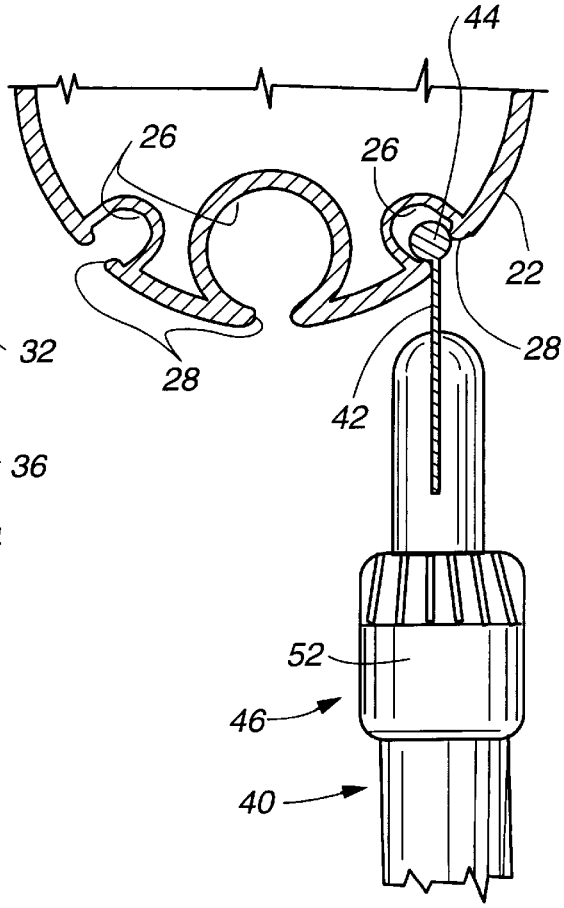
FIG. 4 is an enlarged fragmentary section taken along line 4—4 of FIG. 3.
Figures 6, 7:
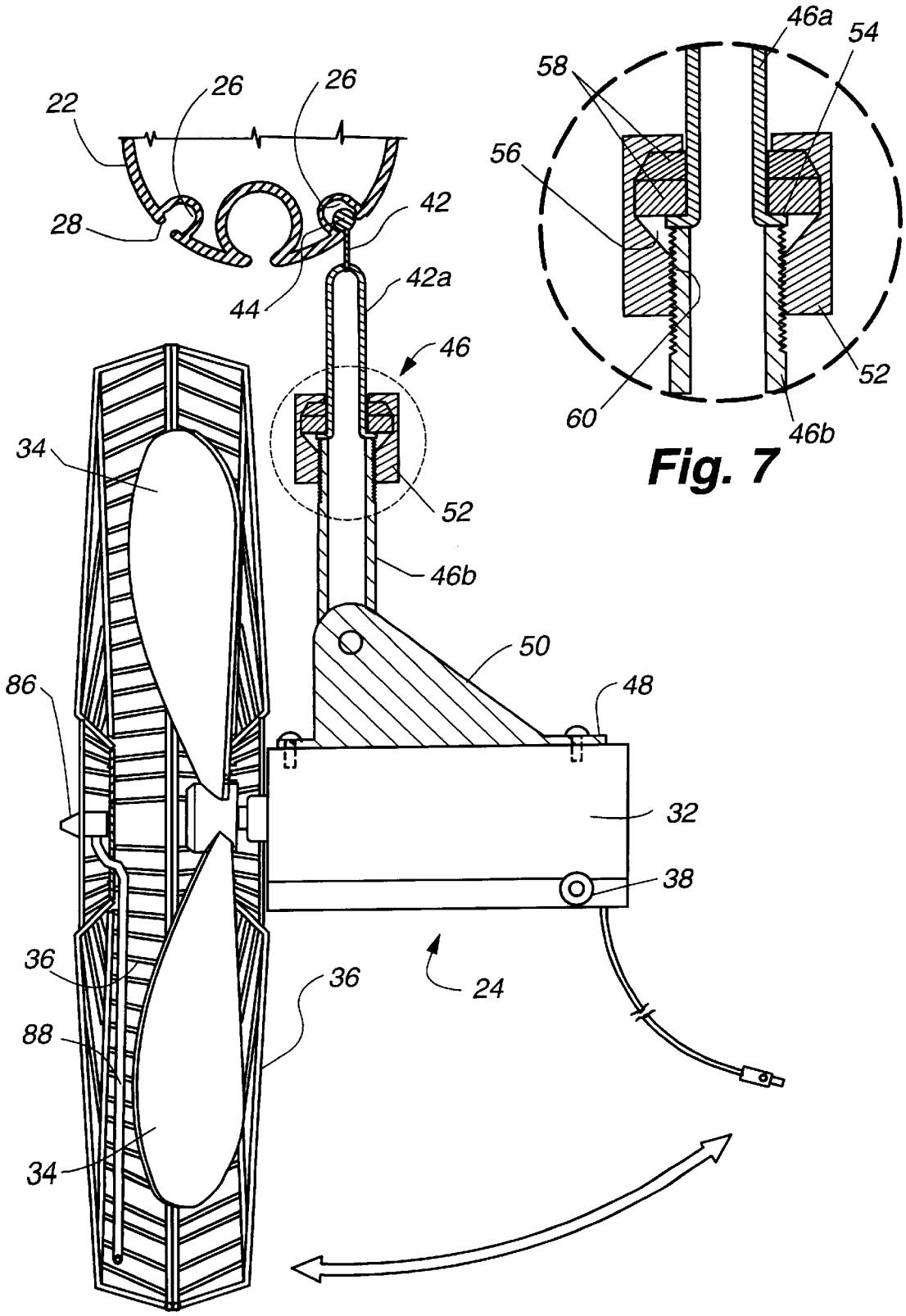
FIG. 6 is an enlarged fragmentary section taken along line 6—6 of FIG. 3.
FIG. 7 is an enlarged view of the area shown in circled dashed lines in FIG. 6.

The roll bar 22, as best seen in FIGS. 2, 4, and 6, is an elongated cylindrical body usually of extruded aluminum with a plurality of longitudinally extending grooves 26 formed therein. The grooves are of substantially circular cross section and have a larger internal diameter than the width of the slot 28 through which they open through the outer surface of the roll bar. The grooves are utilized in a conventional way to anchor the outer edge 20 of the awning sheet and other accessory items, such as a valance 30 as seen in FIG. 1.

The fan 24 is removably mounted on and supported by the roll bar 22 once the awning has been moved to the extended position. In the extended position, the groove 26 provided for receiving and supporting the fan is exposed and not otherwise covered by the canopy which in fact does cover the grooves when the awning is retracted.

As probably best seen in FIG. 2, the fan includes an electric rotary motor 32 having conventional fan blades 34 mounted on its output shaft with the fan blades being concealed within a fan cage 36. The fan cage is secured to the housing for the motor 32 in any conventional manner and the motor includes a switch 38 for varying the speed of the fan. The motor is supported from the roll bar 22 by a support structure 40 that includes an upper plate 42 with an elongated cylindrical bead 44 extending horizontally along an upper edge thereof, an adjustable vertical support shaft 46, and a lower mounting bracket 48 having an upstanding gusset 50 to which the lower end of the support shaft is adjustably mounted.

The elongated bead 44 has a diameter that is less than the internal diameter of the groove 26 in the roll bar in which it is slidably disposed but a greater diameter than the width of the slot 28 opening through the outer surface of the roll bar 22. The upper plate 42 is of a thickness that is slightly less than the width of the slot 28 opening through the outer surface of the roll bar so that the upper plate can protrude through the slot in a vertically downwardly oriented direction as shown in FIG. 4. As probably best illustrated in FIGS. 6 and 7, the support shaft 46 is a two-piece tubular shaft with an upper segment 46*a* and a lower segment 46*b* that are joined by a lock collar 52. The upper segment 46*a* has a radial flange 54 at its lower end while the lower segment 46*b* has the upper end thereof externally threaded and adapted to abut against the radial flange. The lock collar has a relatively large internal cavity 56 that confines a pair of expansion washers 58 and the collar further has an internally threaded passage 60 at its lower end for threadedly receiving the external threads on the lower segment 46*b* of the support shaft so that the collar can be threadedly advanced upwardly or downwardly along the support shaft. The collar has an opening 60 through the top that receives the upper segment 46*a* of the support shaft and as best seen in FIG. 7, the expansion washers are seated on the flange 54 while being confined within the cavity 56 in the lock collar.

The support shaft 46 is designed in two pieces to allow adjustment of the fan orientation about a vertical axis that extends through the support shaft. In operation, the lock collar 52 is loosened relative to the upper segment 46*a* by rotating the lock collar in a counter-clockwise direction when viewed downwardly so that the expansion washers 58 are loosely disposed within the cavity 56 and the lower segment 46*b* of the support shaft is no longer engaged with the upper segment. The lower segment can then be rotated about its longitudinal axis until the fan blades are oriented as desired and once the blades are desirably oriented, the lock collar is rotated in a clockwise direction as viewed from the top until the expansion washers are compressed into engagement with the flange 54 whereupon they expand and grip the upper segment while the collar draws the lower segment 46*b* into tight abutting relationship with the upper segment 46*a* thereby immobilizing the upper and lower segments relative to each other. This, of course, retains the fan in a desired position relative to a vertical axis.

Figure 5:
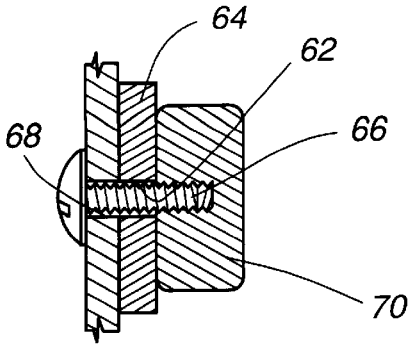
FIG. 5 is an enlarged fragmentary section taken along line 5—5 of FIG. 3.

The adjustment of the orientation of the fan relative to a horizontal axis is achieved with the connection of the lower end of the support shaft 46 to the gusset 50 on the bracket 48. The lower end of the support shaft has a transverse opening 62 therethrough as seen best in FIG. 5 and is positioned in contiguous side-by-side relationship with the gusset. The lower end 64 of the support shaft is flat in configuration so as to be disposed in flat abutting relationship with the gusset. A threaded fastener 66 is extended through a horizontal opening 68 in the gusset near the upper edge thereof and through the opening 62 in the lower end of the support shaft whereupon it is threaded onto a finger manipulatable knob 70 so that tightening of the knob on the fastener compresses the support shaft against the gusset to frictionally retain a desired fixed position, When the knob is loosened, the fan can be rotated about the horizontal axis of the fastener to a desired position and subsequently fixed in that position by tightening the knob.

The fan 24 is preferably an electric fan driven off a 12 volt power source and includes an electric power cord 72 with a plug 74 on the end thereof. The plug is adapted to be received in a socket 76 provided on the outer end of an electrical power supply cord 78 that is wrapped or otherwise disposed on a rafter arm 16 at one end of the awning. It will therefore be appreciated that it is a simple matter to plug the fan into the electrical power source once the fan is mounted on the roll bar 22.

As can be appreciated by reference to FIG. 2, the roll bar 22 has end caps 80 (only one being seen) on the ends of the roll bar but the caps are provided with slotted openings 82 in alignment with the groove 26 adapted to receive the fan 24 so that the fan can be easily mounted or removed from the roll bar.

The fan 24 is provided with a mister system 84 adapted to spray a cooling liquid such as water into the stream of air emanating from the fan so that the air becomes humidified thereby improving the cooling effect beneath the awning. The mister system includes a pair of diametrically opposed spray nozzles 86 secured to the fan cage 36 with appropriate clips 86 on the interior thereof immediately in front of the fan blades. The two nozzles are interconnected with a liquid flow line 88 and one of the nozzles has a liquid connector tube 90 with a male adapter 92 designed to be easily connected to a female adapter 94 on the end of a liquid supply hose that extends along one of the support arms 18. The liquid supply hose can be connected to a pressurized water source or the like on the vehicle while the electric power supply cord 78 can be connected to a 12 volt battery source typically found on such recreational vehicles and the like.

Pursuant to the above, in operation of the fan, once the awning has been unrolled to the extended position illustrated in FIG. 1, the groove 26 in which the fan is to be mounted is exposed and opens through the roll bar substantially in a downward direction. The bead 44 on the support structure 40 for the fan can be slid axially into the groove on the roll bar and positioned at any location along the length of the roll bar as desired. The electric cord from the fan and the liquid connector tube from the mister system 84 are then connected to their respective sources and the orientation of the fan is adjusted about a vertical axis by the lock collar 52 and about a horizontal axis with the finger knob 70. The fan can then be activated by activating the electrical power source and the mister system selectively activated by allowing pressurized liquid such as water to flow into the liquid supply hose. When it is desired to retract the awning, the reverse procedure is followed and the fan can merely be stored in a convenient location within the vehicle.

Although the present invention has been described with a certain degree of particularity, it is understood that the present disclosure has been made by way of example and changes in detail and structure may be made without departing from the spirit of the invention as defined in the appended claims.

I claim:

1. In a retractable awning of the type that is movable between an extended and a retracted condition, said awning having a flexible canopy, a rotatable roll bar having an elongated recess formed therein and secured to an edge of the canopy about which the canopy is rolled when the awning is in its retracted condition, and a support system for the roll bar, wherein the improvement comprises a fan mounted on said roll bar to move air beneath said canopy when the awning is in the extended position, said fan further comprising a support structure for suspending said fan from said roll bar, said support structure including an elongated bead slidably disposed within said elongated recess.

2. In the retractable awning of claim 1 wherein said fan is removably mounted on said roll bar to permit said awning to be moved into its retracted condition when the fan is removed from the roll bar.

3. In the retractable awning of claim 1 wherein said fan includes a mister and a liquid supply hose.

4. In the retractable awning of claim 3, said mister including at least one spray nozzle operably connected to said supply hose, said fan being adapted to move a stream of air away from said fan, and wherein said nozzle is positioned in the stream of air.

5. In the retractable awning of claim 4 wherein said fan includes rotating fan blades and a cage surrounding said fan blades, and wherein said spray nozzle is disposed inside said cage with the fan blades.

6. In the retractable awning of claim 3 wherein said support system of the awning includes a pair of support arms and a pair of rafter arms and wherein said fan is an electric fan and includes an electrical power supply cord, said electrical power supply cord and said liquid supply hose operably extending along at least one of said support arms or rafter arms for connection to a power supply and a liquid supply respectively.

7. In the retractable awning of claim 1 wherein said support structure includes means for adjusting the orientation of the fan relative to the roll bar about horizontal and vertical axes.

* * * * *